US006853352B2

(12) United States Patent
Nevermann et al.

(10) Patent No.: US 6,853,352 B2
(45) Date of Patent: Feb. 8, 2005

(54) MOBILE TELEPHONE INCLUDING A MULTI-BAND ANTENNA

(75) Inventors: Peter Nevermann, San Diego, CA (US); Sheng-Gen Pan, Kamp-Lintfort (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/398,665

(22) PCT Filed: Oct. 5, 2001

(86) PCT No.: PCT/DE01/03832

§ 371 (c)(1),
(2), (4) Date: Oct. 9, 2003

(87) PCT Pub. No.: WO02/29926

PCT Pub. Date: Apr. 11, 2002

(65) Prior Publication Data

US 2004/0051672 A1 Mar. 18, 2004

(30) Foreign Application Priority Data

Oct. 5, 2000 (DE) ..... 100 49 410

(51) Int. Cl.[7] ..... H01Q 1/36; H01Q 1/24
(52) U.S. Cl. ..... 343/895; 343/702
(58) Field of Search ..... 343/702, 725, 343/850, 853, 895

(56) References Cited

U.S. PATENT DOCUMENTS

| | | | | |
|---|---|---|---|---|
| 6,348,895 | B1 * | 2/2002 | Tay et al. | 343/702 |
| 6,362,793 | B1 * | 3/2002 | Sawamura et al. | 343/702 |
| 6,366,247 | B1 * | 4/2002 | Sawamura et al. | 343/702 |
| 2002/0000940 | A1 * | 1/2002 | Moren et al. | 343/702 |

FOREIGN PATENT DOCUMENTS

| | | |
|---|---|---|
| DE | 298 16 142 | 6/1999 |
| DE | 199 41 343 A1 | 3/2001 |
| EP | 0 954 054 A1 | 11/1999 |
| WO | WO 97/49141 | 12/1997 |
| WO | WO 99/22420 | 5/1999 |
| WO | WO 00/65684 | 11/2000 |
| WO | WO 01/56111 | 8/2001 |
| WO | WO 01/56112 | 8/2001 |

* cited by examiner

*Primary Examiner*—Don Wong
*Assistant Examiner*—Minh Dieu A
(74) *Attorney, Agent, or Firm*—Bell Boyd & Lloyd LLC

(57) ABSTRACT

A multi-band antenna for use in a mobile radio telephone. The antenna includes first and second meandering conductor structures and a contact spring connecting the conductor structures to a transmitter/receiver. The meandering conductor structures and contact spring are formed as a single-piece punched and bent part, without overlapping of the components.

19 Claims, 2 Drawing Sheets

MOBILE TELEPHONE INCLUDING A MULTI-BAND ANTENNA

BACKGROUND

The present invention relates to a mobile radiotelephone including a multi-band antenna having a meandering conductor structure and a contact spring for contacting the conductor structure to a transmitting-receiving electronics device.

Mobile radiotelephones of this type can be implemented as a mobile telephone, for example. The dimensions of the antenna of such a device, wherein antennas are now integrated into the housing on a wide scale, are restricted for reasons of design. Furthermore, this mobile radiotelephone should also be increasingly capable of operating not only in a single network, corresponding to a single frequency range, but also in a plurality of networks, corresponding to a plurality of frequency ranges. An integrated antenna is therefore required that is capable of being used in two or more frequency ranges. In addition, there is a requirement that the mobile radiotelephone in question should be able to be implemented as cost-effectively as possible with respect to its performance capabilities and its design.

A multi-band antenna integrated into the housing of known mobile radiotelephones consists, for example, of a plurality of partial antennas. With regard to these partial antennas, these are either cylindrically symmetric helical wire structures or planar antennas that are preferably implemented on circuit boards. However, since their basic forms do not compound to the shape of the housing, which typically has a generally elliptical cross-section, such antennas require a relatively high amount of space in the housing. For this reason, the requirements relating to the design of the mobile radiotelephone cannot be complied with or can only be complied with inadequately, given the small dimensions.

A known method for implementing a multi-band antenna of the mobile radiotelephone in question by meandering structures on a flexible printed circuit board material. A multi-band antenna of this type exhibits great flexibility as a result. The costs that result for the flexible base material and the requisite contact to the flexible conductor material, however, are a multiple of the costs of the aforementioned nonflexible antenna.

SUMMARY

An example of a multi-band antenna for use in a mobile radio telephone is disclosed. The antenna includes a first meandering conductor structure, second meandering conductor structure and a contact spring configured to connect the first and second conductor structures to a transmitting receiving electronics device. The first and second meandering conductor structures and the contact spring are formed as a single-piece punched and bent part where the first, second meandering conductor structure, second meandering conductor structure and contact spring do not overlap one another. Additionally, the first and second meandering conductors are located in respective laterally displaced planes.

In another disclosed example, a multi-band antenna is disclosed where the first meandering conductor structure and second meandering conductor structure are located on respective first and second curved surfaces.

DETAILED DESCRIPTION OF THE PRESENT EXAMPLES

Figure 1:
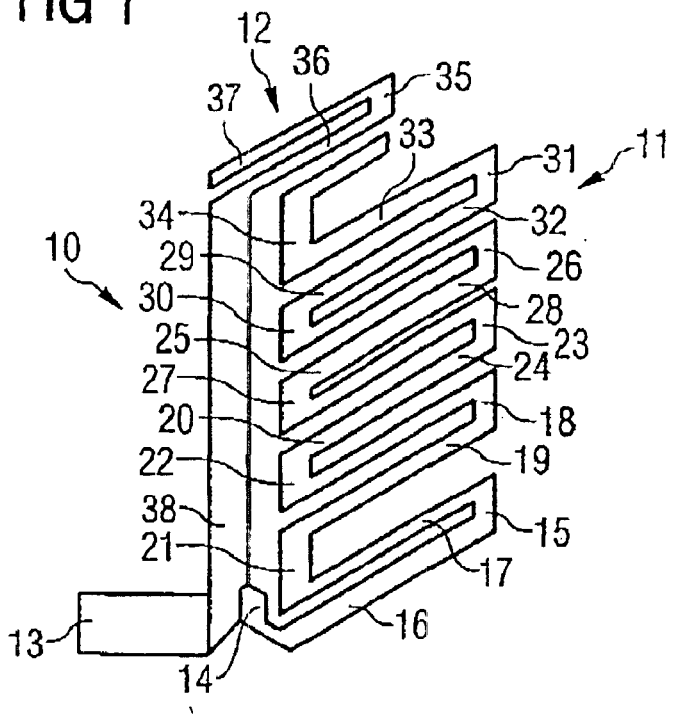
FIG. 1 illustrates a side elevation view of a disclosed multi-band antenna of a mobile radiotelephone.

In FIG. 1, a multi-band antenna is denoted generally by the reference number 10. With regard to the multi-bend antenna 10, this is a single-piece punched and bent part including a meandering conductor structure with a first meandering conductor structure 11, a second meandering conductor structure 12 and a contact spring 13. The two meandering conductor structures 11, 12 and the contact spring 13 are located relative to one another in such a way that there is no overlap in their development (in a developed state). The development of the first meandering conductor structure 11 is formed in planar fashion in the same way as the second meandering conductor structure 12, and these two meandering conductor structures are situated in two laterally displaced planes in their developed state and are connected with one another with a connecting piece 14 that is positioned at right angles to the meander planes. The contact spring 13 is located in the area of the connecting piece 14 and represents an extension of this connecting piece.

The first meandering conductor structure 11 includes a first meander section 15, starting from the connecting piece 14, with two arms 16 and 17 running parallel to one another. The first meander section 15 is followed by a second meander section 18, which includes two arms 19 and 20 running parallel to one another and also parallel to the arms 16, 17 of the first meander section 15. The second meander section 18 is connected to the first meander section 17 by a crosspiece 21. The second meander section is followed, connected by a crosspiece 22, by a third meander section 23, which includes two arms 24, 25 running parallel to one another and also parallel to the aforementioned arms 16, 17 and 19, 20. The third meander section 23 is followed by, a fourth meander section 26, which is connected to the preceding meander section 23 by a crosspiece 27 and includes two arms 28 and 29 that run parallel to one another and also to the aforementioned arms. The fourth meander section 26 is connected by a crosspiece 30 to a following fifth meander section 31, which, like the preceding meander sections, includes two arms 32 and 33 in parallel alignment. The fifth meander section 31 runs into a terminating arm 34 extending in the meander direction and bent inwards by 90°.

The mutual spacing of the five meander sections 15, 18, 23, 26, and 31 is chosen to be different in each case in the same way as is the relative spacing of their arms 16, 17, 19, 20, 24, 25, 28, 29, 32 and 33. These spacings and their sequence are optimized in favor of the frequency range to be covered by the antenna.

The second meandering conductor structure 12 has a less complex structure than the first meandering conductor structure 11 and includes a single meander section 35 located at a distance above the terminating arm 34 of the first meander section 11 and has arms 36, 37 running parallel to one another and also to the arms of the first meandering conductor structure 11. The meander section 35 is connected by means of its lower arm 36 by a further, long connecting piece 38 to the contact spring 13 and the connecting piece 14.

Figure 3:
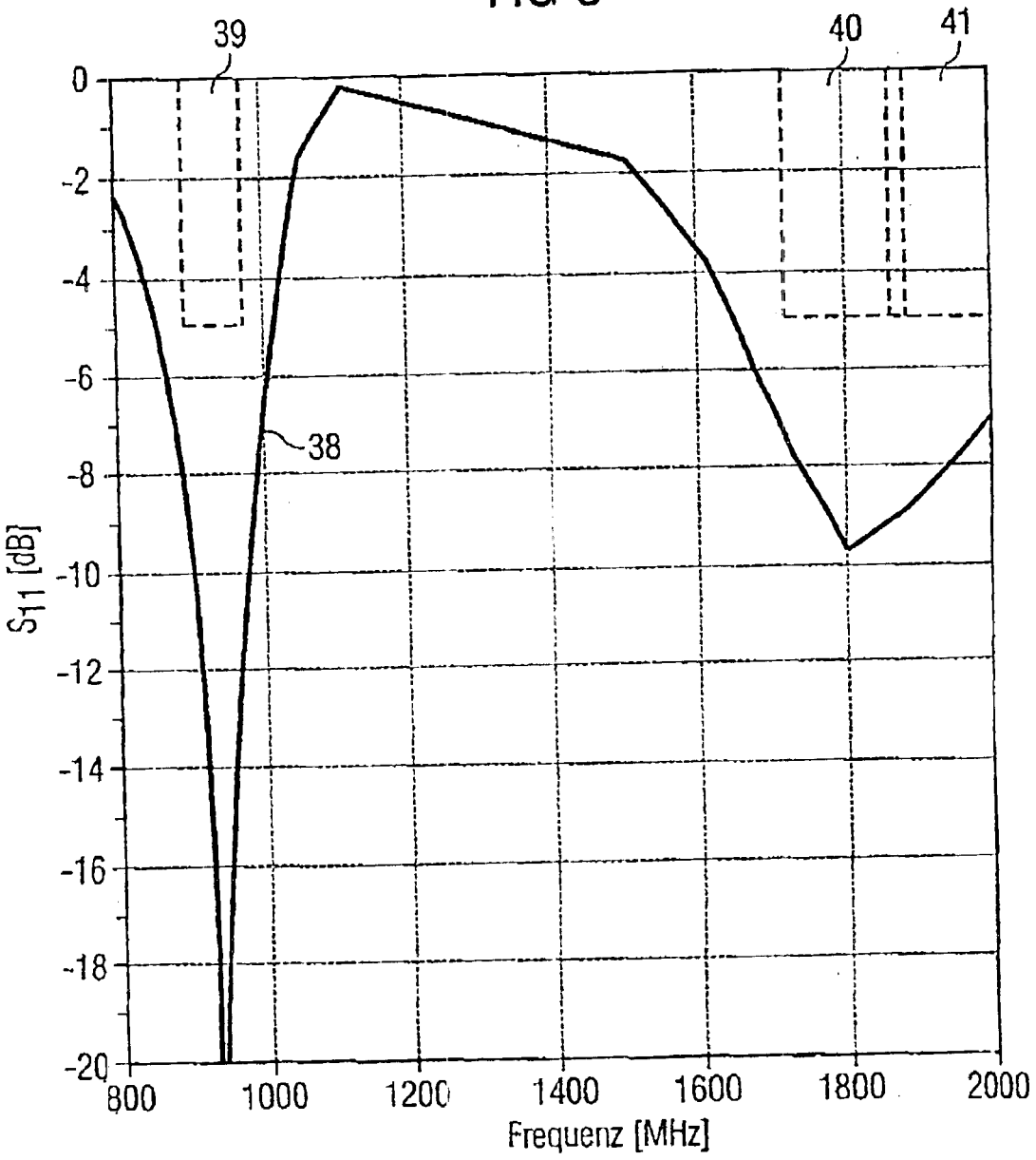
FIG. 3 illustrates a diagrammatic form of the reflection coefficient of the multi-band antenna illustrated in FIG. 1, wherein the frequency bands covered by the antenna are shown with dashed lines.

Three frequency ranges total are defined as a result of the meandering conductor structures 11, 12 of the multi-band antenna 10. The pertinent reflection coefficient of the multi-band antenna 10 is shown in FIG. 3 as a solid line and generally denoted by the reference number 38. The three frequency ranges or bands of the multi-band antenna 10, corresponding to the EGSM band, the PCN band and the PCS band, are shown in dashed lines and are denoted by the reference numbers 39, 40 and 41.

Figure 2:
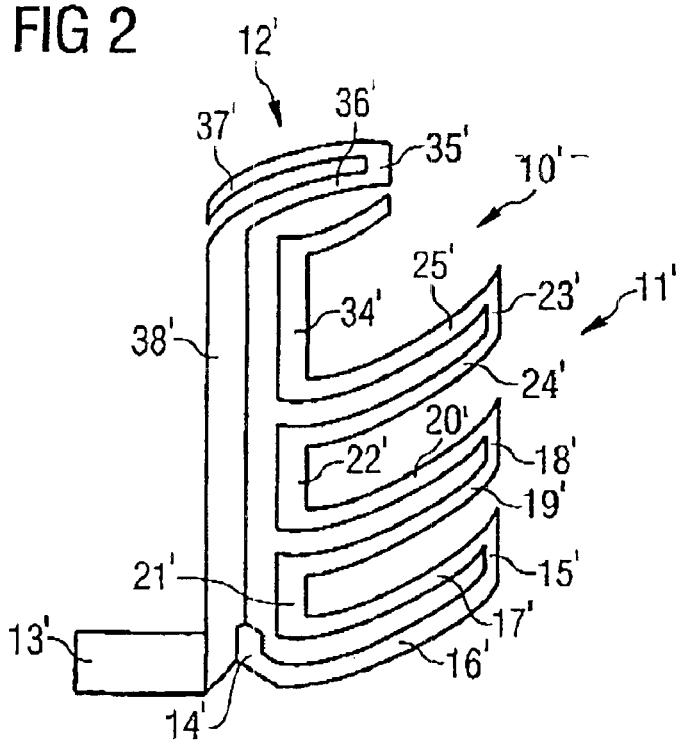
FIG. 2 illustrates a side elevation view of another disclosed multi-band antenna of a mobile radiotelephone.

FIG. 2 shows another example of the multi-band antenna 10 shown in FIG 1. The multi-band antenna 10 shown in FIG. 2 essentially has the same basic structure as the multi-band antenna 10 shown in FIG. 1, but with the difference that the development of the meandering conductor structures is not located in flat planes but on curved surfaces and with the difference that the first meandering conductor structure 11 includes not five, but simply three meander sections. The second meandering conductor structure 12' on the other hand is configured corresponding to the first meandering conductor structure 11. The same elements of the antenna 10' are denoted by the same reference numbers as for the antenna 10, for which reason a detailed description of these elements is unnecessary. A further difference distinguishing the antenna 10' from the antenna 10 is the fact that the distances between their meander sections and also the distances between the arms of the meander sections are different, with the result that a different reflection coefficient is produced for the antenna 10' than is the case with the antenna 10.

Because the meandering conductor structure and the contact sprig of the disclosed antenna are formed as a single part, which is non-overlapping in its development, this antenna can be manufactured without any difficulties and cost-effectively by means of a single punching operation, which is then followed simply by an additional bending operation, if necessary. Since the disclosed single-piece punched and bent part can be shaped as desired within broad limits, it can be adapted without any difficulties to the desired design of the mobile radiotelephone without needing to pay attention to the structure of the antenna.

A further advantage of the disclosed antenna consists in the fact that it can be produced with a high speed of manufacture and therefore with low manufacturing costs because it is possible to revert to using the standard punch and bend method. Since the multi-band antenna is designed as a single-piece punched and bent part, there is no need for separate manufacture and provision of the antenna spring.

The two meandering structures, of which there are at least two, of the multi-band antenna formed as a single-piece punched and bent part are connected in parallel and arranged so close to one another that a clear coupling is achieved. This results in the overall volume of the multi-band antenna being kept to a minimum. In this situation, usage of the distributed partial inductances and capacitances of the meandering structures is optimized with the result that the antenna can be operated reliably in a plurality of frequency rages. Through optimization, it is possible to deploy the multi-band antenna in the vicinity of its first resonant frequency for one of the target frequency bands (e.g., GSM) while close to its second resonant frequency it functions in such a broadband manner that this allows an application in the case of two further frequency bands (e.g., PCN and PCS).

A further advantage of the multi-band antenna formed as a single-piece punched and bent part consists in the fact that a rated impedance of 50 Ohms can be implemented without any difficulties, with the cult that this antenna can be operated without an additional adapter network, which is required in the prior art. This ensures that the disclosed antenna can be operated without suffering those losses which are unavoidable as a result of adapter elements.

What is claimed is:

1. A multi-band antenna for use in a mobile radiotelephone, the antenna comprising:

a first meandering conductor structure;

a second meandering conductor structure;

and a contact spring configured to connect the first and second conductor structures to a transmitting-receiving electronics device, wherein the first and second meandering conductor structures and the contact spring are formed as a single-piece punched and bent part where the first and second meandering conductor structures and contact spring do not overlap one another, and wherein the first and the second meandering conductors are located in respective laterally displaced planes.

2. A multi-band antenna according to claim 1, wherein the first and second meandering conductor structures comprise respective meanders of differing configuration in order to provide multi-band functionality of the multi-band antenna.

3. A multi-band antenna according to claim 1, wherein the meandering conductor structures are located beside one another.

4. A multi-band antenna according to claim 3, characterized in that the meanders comprise a different number and/or shape of meander sections.

5. A multi-band antenna according to claim 4, further comprising a triple-band antenna wherein the second meandering conductor structure connects with an end of the first meandering conductor structure furthest from the input/output point, and a second connecting piece connected to the second meandering conductor structure runs along a long side of the first meandering conductor structure.

6. A multi-band antenna for use in a mobile radiotelephone, the antenna comprising:

a first meandering conductor structure;

a second meandering conductor structure;

and a contact spring configured to connect the first and second conductor structures to a transmitting-receiving electronics device, wherein the first and second meandering conductor structures and the contact spring are formed as a single-piece punched and bent part where the first and second meandering conductor structures and contact spring do not overlap one another, and wherein the first meandering conductor structure is located on a first curved surface and the second meandering conductor structure is located on a second cured surface.

7. A multi-band antenna according to claim 6 wherein the meandering conductor structures are connected to one another with a first connecting piece at an antenna signal input/output point.

8. A multi-band antenna according to claim 7, wherein one of the first and second meandering conductor structures is tuned to a first resonant frequency while the other of the first and second meandering conduct structures is turned for greater broadband basis to a second and a third resonant frequency.

9. A multi-band antenna according to claim 6 wherein the first and second meandering conductor structures are configured in a planar fashion.

10. A multi-band antenna according to claim 6 wherein the first and second meandering conductor structures are configured in a curved fashion.

11. A multi-band antenna according to claim 6 wherein the first and second meandering conductor structures have a rated impedance of 50 Ohms overall.

12. A multi-band antenna according to claim 11, wherein the first and second meandering conductor structures comprise respective meanders of differing configuration in order to provide multi-band functionality of the multi-band antenna.

13. A multi-band antenna according to claim 11, wherein the meandering conductor structures are located beside one another.

14. A multi-band antenna according to claim 11, characterized in that the meanders comprise a different number and/or shape of meander sections.

15. A multi-band antenna according to claim 11, wherein the meandering conductor structures are connected to one another with a first connecting piece at an antenna signal input/output point.

16. A multi-band antenna according to claim 11, further comprising a triple-band antenna wherein the second meandering conductor structure connects with an end of the first meandering conductor structure furthest from the input/output point, and a second connecting piece connected to the second meandering conductor structure runs along a long side of the first meandering conductor structure.

17. A multi-band antenna according to claim 11, wherein one of the first and second meandering conductor structures is tuned to a first resonant frequency while the other of the first and second meandering conduct structures is turned for greater broadband basis to a second and a third resonant frequency.

18. A multi-band antenna according to claim 11 wherein the first and second meandering conductor structures are configured in a planar fashion.

19. A multi-band antenna according to claim 11 wherein the first and second meandering conductor structures are configured in a curved fashion.

* * * * *